United States Patent [19]

Knopf et al.

[11] Patent Number: 5,044,275

[45] Date of Patent: Sep. 3, 1991

[54] ELECTROSTATIC PRINTING ASSIST SYSTEM

[75] Inventors: Franz Knopf, Bühl/Stadt; Ernst A. Hahne, Allschwil; Herman Kunzig, Weil am Rhein, all of Fed. Rep. of Germany

[73] Assignee: Eltex Elektrostatik Gesellschaft mbH, Weil am Rhein, Fed. Rep. of Germany

[21] Appl. No.: 381,975

[22] Filed: Jul. 19, 1989

[30] Foreign Application Priority Data

Jul. 20, 1988 [DE] Fed. Rep. of Germany ..... 3824714

[51] Int. Cl.[5] ..... B41F 9/00

[52] U.S. Cl. ..... 101/153; 101/489; 101/DIG. 37

[58] Field of Search ..... 101/489, 153, 216, 219, 101/212, 170, DIG. 37

[56] References Cited

U.S. PATENT DOCUMENTS

| | | | |
|---|---|---|---|
| 2,547,706 | 4/1951 | Huebner | 101/489 |
| 2,558,900 | 7/1951 | Hooper | 101/489 |
| 3,370,546 | 2/1968 | Müller | 101/489 |
| 3,661,081 | 5/1972 | Wright | 101/489 |
| 4,208,965 | 6/1980 | Eichler et al. | 101/219 |
| 4,909,147 | 3/1990 | George et al. | 101/153 |

*Primary Examiner*—Edgar S. Burr
*Assistant Examiner*—Joseph R. Keating
*Attorney, Agent, or Firm*—Antonelli, Terry, Stout & Kraus

[57] ABSTRACT

A counter pressure cylinder including an electrostatic printing assist system, with the counter pressure cylinder including an insulating jacket having a conductive coating thereof over which a further coating is arranged having limited conductivity. A primary winding, concentric to an electrically grounded axle or shaft of the counter pressure cylinder, is disposed beside the counter pressure cylinder in a fixed fashion with respect to the printing unit, and a secondary winding is mounted concentrically to the electrically grounded shaft of the counter pressure cylinder at one end face of the counter pressure cylinder in a fixed fashion with respect to the counter pressure cylinder. An electrical connection of the secondary winding is connected to the axle of shaft of the counter pressure cylinder and another electrical connection is connected to the coating by way of a rectifier circuit.

20 Claims, 2 Drawing Sheets

ELECTROSTATIC PRINTING ASSIST SYSTEM

BACKGROUND OF THE INVENTION

The present invention relates to a printing system and, more particularly, to a counter pressure cylinder having an elastic surface and being adapted to press a paper or web on a surface of a printing cylinder of a printing unit, for example, for photogravour printing, heliogravour and intaglio printing equipped with an electrostatic printing system.

Printing assist systems of the aforementioned type have been proposed in various forms, with the printing assist system serving for a buildup of an electrostatic field in a pressure nip between the pressure or form roller associated with a printing cylinder in order to effect an improved ink transfer to a web, such as, for example, a paper web, traveling in a pressure nip between the counter pressure cylinder and the printing cylinder of the printing unit.

A disadvantage of all printing assist systems resides in the fact that the manufacturing thereof is expensive and already existing printing units for the most part can no longer be retrofitted with such assist systems.

The aim of the present invention essentially resides in providing an electrostatic printing assist system which is simple in construction and which is also capable of being retrofitted or added t existing printing units.

In accordance with advantageous features of the present invention, the counter pressure cylinder is provided, on an insulating jacket thereof, with a coating that is optionally homogeneous but conductive and preferably metallic, with a further coating of a limited conductivity being arranged thereover. A primary winding is disposed concentrically to the electrically grounded axle or shaft of the counter pressure cylinder adjacent the counter pressure cylinder in a fixed fashion with respect to the printing unit. A secondary winding is arranged concentrically to the electrically grounded axle or shaft of the counter pressure cylinder on one of its end faces in a fixed fashion with respect to the counter pressure cylinder, with one of its connections being connected to the axle or shaft and the other connection being connected to the coating by way of a rectifier circuit.

By virtue of the features of the present invention, in principle, a bipartite transformer is utilized, with the primary side of the transformer being fixed to the printing unit and the secondary side thereof being affixed to the counter pressure cylinder for rotation therewith. A voltage induced in the secondary winding is rectified and smoothed by means of a smoothing circuit and then transmitted to the metallic coating of the counter pressure cylinder.

Advantageously, electric charges are produced which are not linked to the conductor and no electrodes for charging the surface of the counter pressure cylinder are required so that use in explosion-protected localities appears particularly suitable.

Additionally, with the constructional features of the present invention, conventional printing units can be retrofitted in a simple manner by utilizing only a counter pressure cylinder constructed in accordance with the present invention and the secondary winding is mounted on one of its end faces with the primary winding being arranged on the axle and/or shaft of the counter pressure cylinder in dependence upon whether the printing cylinder is driven about the axle or revolves rigidly joined thereto as a shaft.

In accordance with the present invention, by virtue of the provision of two additional windings, a voltage effective on a secondary side can be back induced in a simple manner so that, by way of this measurement transducer, control of the induced voltage in the secondary winding is made possible.

In accordance with additional perfecting features of the present invention, the primary and secondary windings, as well as the second primary and second secondary windings may include a number of component windings each of which is wound up on, for example, bar magnets, with the bar magnets lying in mutual opposition through the nip. All of the magnets preferably extend in parallel in axis of the printing cylinder and are located in mutual alignment.

Moreover, according to the present invention, the bar magnets associated with the primary winding and the second primary winding are arranged at differing radial distances from an axis of the counter pressure cylinder and this may also hold true for the secondary winding and the second secondary winding. By virtue of this arrangement, magnetic induction is generated by a relative velocity between the primary and secondary windings.

Additionally, in accordance with the present invention, it is also possible for the coating to be connected by way of a voltage multiplier circuit.

Advantageously, the smoothing circuit of the present invention for the pulsating direct current is arranged between the rectifier circuit and the metallic coating.

The primary winding is associated with a second primary winding and the secondary winding is associated with the second secondary rotating with this winding and connecting in parallel thereto, with the secondary winding lying in opposition to the second primary winding.

Advantageously, the primary winding can be connected to a source of AC voltage with a frequency of $10\pm5$ kHz, with the source being variable by way of a control unit.

According to the invention, the second primary winding may be connected to the input of the control unit and a plurality of first bar magnets may be provided in place in of the primary winding.

The primary winding may, according to the present invention, include a number of component windings corresponding to the number of bar magnets, with the component windings being wound upon the magnet. Likewise, the secondary winding may include a number of component windings corresponding to the number of first bar magnets, with these components also being wound upon the second bar magnets arranged in alignment with the first bar magnets.

It is also possible for the second primary winding to include a number of component windings corresponding to the number of third bar magnets, with each of these component windings being wound up on one of the third bar magnets.

The second secondary winding may include a number of component windings corresponding to the number of third bar magnets, with the component windings being wound up on fourth bar magnets arranged in alignment with the third bar magnets, and the secondary winding may be connected to the coating by way of the voltage multiplier.

The above and other objects, features, and advantages of the present invention will become more apparent from the following description when taken in connection with the accompanying drawings which show, for the purpose of illustration only, several embodiments in accordance with the present invention.

DETAILED DESCRIPTION

Figure 1:
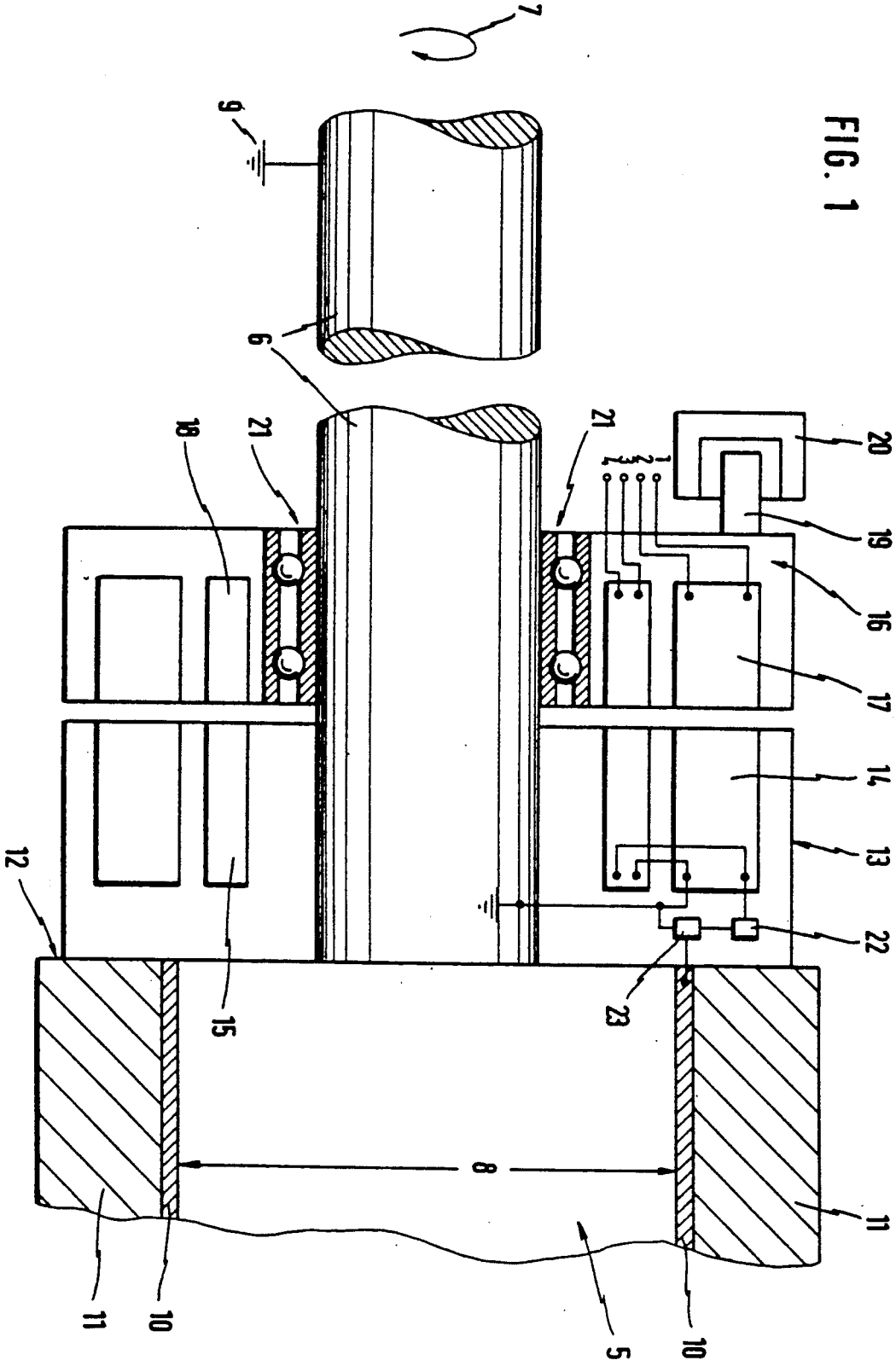
FIG. 1 is a fragmentary partially schematic cross sectional view of a counter pressure cylinder constructed in accordance with the present invention.

Referring now to the drawings wherein like reference numerals are used throughout the various views to designate like parts and, more particularly, to FIG. 1, according to this FIGURE, a counter pressure cylinder generally designated by the reference numeral 5 is non rotatably mounted on a shaft 6, with the shaft 6 revolving in the direction of the arrow 7 and being grounded at 9. The counter pressure cylinder 5 is constructed in a conventional manner in an area 8 and includes an insulating jacket having a metallic coating 10, with another conductive coating 11 being applied over the metallic coating 10.

A first mounting means generally designated by the reference numeral 13 is disposed concentric to the shaft 6 of the counter pressure cylinder 5 and adjacent thereto at one end face 12 and is fashioned as a magnetizable core, with a first secondary winding 14 as well as a second secondary winding 15 each being disposed concentrically to the shaft 6.

Another mounting means generally designated by the reference numeral 16 is concentrically disposed with respect to the shaft 6 and is fashioned as a magnetizable core for mounting a first primary winding 17 which is likewise concentric to the shaft 6, with electric connections 1, 2 as well as a second primary winding 18, arranged between the primary winding 17 and the shaft 6 with electric connections 3, 4. The mounting means 16 is rotatable with respect to the shaft 6 by a pivot means 19 engaging into an anchoring means 20 fixed with respect to the printing unit and includes, on an interior thereof, a ball bearing arrangement generally designated by the reference numeral 21 correlated with the shaft 6 so that the shaft 6 can revolve or rotate but the magnetizable core is held nonrotationally with respect to the unit due to the pivot 19 and the anchoring means 20.

A rectifier circuit 22 and smoothing circuit 23, both of conventional construction, are provided on the secondary side of the first mounting means 13, with the smoothing circuit having an output connected to the metallic coating 10.

Figure 2:
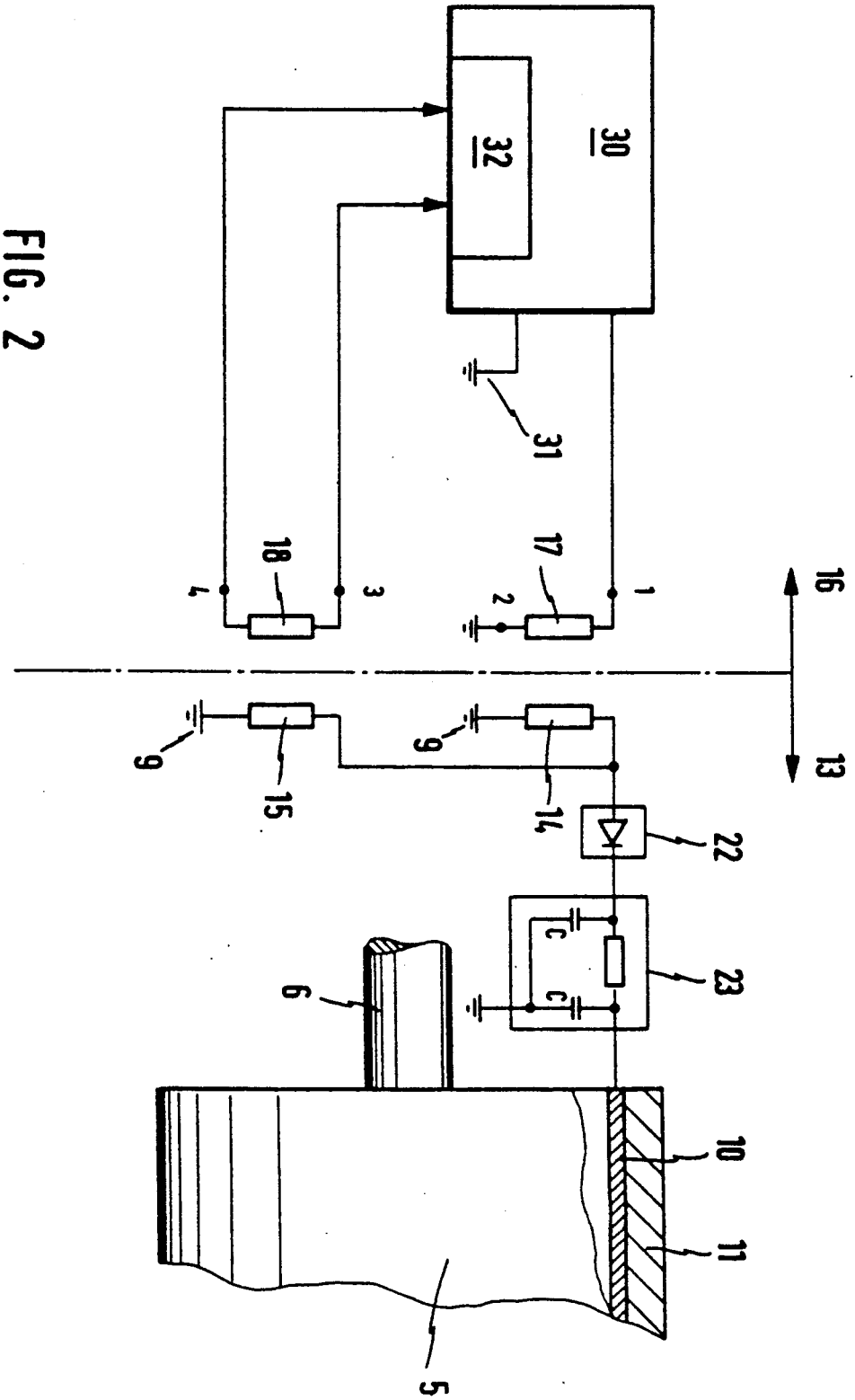
FIG. 2 is a partially schematic view of an electric circuit diagram of the construction of the present invention.

As shown in the circuit diagram of FIG. 2, one of the electric terminals 2 of the primary winding 17 is grounded; whereas, the terminal 1 is connected to a high voltage generator 30 with a variable alternating voltage in a frequency of preferably 10 kHz, and a source of AC voltage 30 is grounded by a grounding connection 31.

The two electric connections or terminals 3, 4 of the second primary winding 18 are connected to inputs of a control device of the variable AC voltage source 30 and it can vary the magnitude of the output voltage and/or the frequency in a conventional manner.

The secondary winding 14 is grounded at one of its sides at a ground 9 and the same holds true for the second secondary winding 15. Both secondary windings 14, 15 are connected in parallel and the rectifier circuit 22 for rectifying the alternating current follows first after both windings. The rectifier circuit 22 is followed by the smoothing circuit 23 with a conventional LC filter. The output of the smoothing circuit 23 is connected to the metallic coating 10 of the counter pressure cylinder 5.

In operation, the primary winding 17 and the secondary winding 14 are moved toward each other. Thus, by way of an air gap between the two magnetizable cores 13, 16, the AC voltage in the primary winding 17 can induce a secondary voltage in the secondary winding 14 which is rectified by way of the rectifier circuit 22 and smoothed by way of the smoothing circuit 23 and, in this form, is directly transmitted to the metallic coating 11. In a reverse sense, the induced voltage of the secondary winding 14 is tapped by the second secondary winding 15 and reversely induced into the second primary winding 18, with the secondary winding 18 being connected by its electric terminals 3, 4 to the control unit 32. The control unit 32 controls the source of the AC voltage 30 in such a manner, for example, in all cases the same DC voltage is applied to the metallic coating 10.

A magnetic circuit 40 for energy transmission as well as a magnetic circuit 41 for a measurement transducer are also provided.

While we have shown and described several embodiments in accordance with the present invention, it is understood that the same is not limited thereto but is susceptible to numerous changes and modifications as known to one of ordinary skill in the art, and we therefore do not wish to be limited to the details shown and described herein but intend to cover all such modifications as are encompassed by the scope of the appended claims.

WE CLAIM:

1. A counter pressure cylinder of a printing unit including an electrostatic printing assist system, the counter pressure cylinder comprising a first homogeneous conductive coating means provided on an insulated jacket of the counter pressure cylinder, a second coating means of limited conductivity arranged over said first coating means, a first primary winding means disposed concentrically to an electrically grounded shaft means of the counter pressure cylinder means and fixedly arranged adjacent the counter pressure cylinder with respect to the printing unit, a first secondary winding disposed concentrically to the electrically grounded shaft means of the counter pressure cylinder means and fixedly arranged on one end face thereof and a rectifier circuit means, wherein a first electrical terminal of said secondary winding means is electrically connected to the shaft means of the counter pressure cylinder, and a second electrical terminal of the secondary winding means is connected to the first coating means through said rectifier circuit means.

2. A counter pressure cylinder according to claim 1, further comprising a smoothing circuit means for a pulsating direct current arranged between the rectifier circuit means and said first coating means.

3. A counter pressure cylinder according to claim 2, further comprising a second primary winding means associated with the first primary winding means, a second secondary winding means associated with the first secondary winding means and rotating with said first secondary winding means and connected in parallel thereto, said second secondary winding means lying in opposition to said second primary winding means.

4. A counter pressure cylinder according to claim 3, wherein the first primary winding means is connected to an AC voltage source means having a frequency of 10±5 kHz, and wherein a control means is provided for variably controlling the voltage source means.

5. A counter pressure cylinder according to claim 4, wherein the second primary winding means is connected to an input of the control means.

6. A counter pressure cylinder according to claim 5, wherein the first coating means includes a metallic coating material.

7. A counter pressure cylinder according to claim 1, further comprising a second primary winding means associated with the first primary winding means, a second secondary winding means associated with the first secondary winding mean and rotating with said first secondary winding means and connected in parallel thereto, said second secondary winding means lying in opposition to said second primary winding means.

8. A counter pressure cylinder according to claim 7, wherein the first primary winding means is connected to an AC voltage source means having a frequency of 10±5 kHz, and wherein a control means is provided for variably controlling the voltage source means.

9. A counter pressure cylinder according to claim 7, wherein the second primary winding means is connected to an input of the control means.

10. A counter pressure cylinder to claim 1, wherein the first primary winding means is connected to an AC voltage source means having a frequency of 10±5 kHz, and wherein a control means is provided for variably controlling the voltage source means.

11. A counter pressure cylinder according to claim 10, wherein the second primary winding means is connected to an input of the control means.

12. A counter pressure cylinder according to claim 1, wherein a plurality of first bar magnets are provided in place of the first primary winding means.

13. A counter pressure cylinder according to claim 12, wherein the primary winding means includes a plurality of component windings corresponding in number to the number of bar magnets, said component windings being respectively wound up on the first bar magnets.

14. A counter pressure cylinder according to claim 13, wherein the secondary winding means includes a plurality of component windings corresponding in number to the number of first bar magnets, and wherein said component windings of said secondary winding means are wound up on second bar magnets arranged in alignment with the first bar magnets.

15. A counter pressure cylinder according to claim 14, wherein the second primary winding means includes a plurality of component windings corresponding in number to a number of third bar magnets, each of the component windings of the second primary winding means being respectively wound on the third bar magnets.

16. A counter pressure cylinder according to claim 15, wherein the second secondary winding means includes a plurality of component windings corresponding in number to the number of third bar magnets, and wherein the component windings of the second secondary winding means are wound up on fourth bar magnets arranged in alignment with the third bar magnets.

17. A counter pressure cylinder according to claim 1, further comprising a voltage multiplier means for connecting the secondary winding means with the first coating means.

18. A counter pressure cylinder according to claim 1, wherein said rectifier circuit means is fixed to said one end face of said counter pressure cylinder.

19. A counter pressure cylinder according to claim 18, further comprising a smoothing circuit means for a pulsating direct current arranged between the rectifier circuit means and said first coating means.

20. A counter pressure cylinder according to claim 19, further comprising a second primary winding means associated with the first primary winding means, a second secondary winding means associated with the first secondary winding means and rotating with said first secondary winding means and connected in parallel thereto, said second secondary winding means lying in opposition to said second primary winding means.

* * * * *